United States Patent [19]

Kawana et al.

[11] Patent Number: 4,813,922

[45] Date of Patent: Mar. 21, 1989

[54] ZIGZAG FOLDING APPARATUS FOR A FORM PRINTING MACHINE

[75] Inventors: Fujio Kawana, Kure; Tsukasa Kurokawa, Higashihiroshima; Tadayuki Yoneki, Hiroshima, all of Japan

[73] Assignee: Fuji Kikai Kogyo Co., Ltd., Hiroshima, Japan

[21] Appl. No.: 114,805

[22] Filed: Oct. 29, 1987

[30] Foreign Application Priority Data

Nov. 4, 1986 [JP] Japan ..... 61-169772[U]
Aug. 14, 1987 [JP] Japan ..... 62-124667[U]

[51] Int. Cl.[4] ..... B41F 13/54
[52] U.S. Cl. ..... 493/415; 270/39
[58] Field of Search ..... 493/413, 414, 415, 430; 270/39

[56] References Cited

U.S. PATENT DOCUMENTS 4,623,136 11/1986 Bunch, Jr. ..... 270/39 X

*Primary Examiner*—Eugene R. LaRoche

*Assistant Examiner*—Robert J. Pascal

*Attorney, Agent, or Firm*—Jordan and Hamburg

[57] ABSTRACT

A zigzag folding apparatus for a form printing machine, having: a pair of rolls for outfeeding a paper strip being mounted to folding arms for folding the paper strip in a zigzag, one of the folding arms having a swing lever synchronized for swinging motion with the arm, a swing center of the lever coinciding coaxially with the point of contact between both the rolls, so that the rolls can perform an auxiliary folding operation to assist the folding operation of the folding arms under the condition in which the point of outfeeding the paper strip remains stationary; and a swing drive mechanism for activating the swing lever having main shafts on the drive side and out shafts for a swing section disposed in parallel relationship, the main shaft and the output shaft being connected one another by means of a shift transmitting mechanism in which a ratio of transmitting is chaged by operating a screw from the outside, so that the adjustment can be made according to a width of swing on the swing lever and the locations of folding the paper strip during the running of the machine.

2 Claims, 9 Drawing Sheets

ZIGZAG FOLDING APPARATUS FOR A FORM PRINTING MACHINE

BACKGROUND OF THE INVENTION AND RELATED ART STATEMENT

The present invention relates to a zigzag folding apparatus utilized in a form printing machine for folding a paper form strip, primarily provided with perforated lines formed in a processing section of the machine after printing, in a zigzag along the perforated lines arranged transversely therein.

In FIG. 13, a form printing machine in the complete arrangement is shown which is utilized for printing paper forms such as computor oriented business forms or the like. The letter A is a paper infeed section for feeding a strip of rolled paper P while the letter B is a printing section having a plurality of printing units B1 for performing offset printing on the paper strip P infed. Then, the paper strip P printed is transffered from the section B through a processing section, in which punching and lengthwise and widthwise perforating operations are carried out, finally to a paper exit section D. The paper exit section D includes the zigzag folding apparatus D1 in which the paper strip P printed and processed is folded consecutively in a zigzag along the transverse perforated lines formed therein.

A known arrangement of the zigzag folding apparatus D1 will be described as best shown in FIGS. 11 and 12.

The numeral 1 is a folding arm which is rotatably supported at the upper end thereof by a horizontal shaft 2 thus to move about the horizontal shaft 2 (which will be termed an arm-center shaft below) in rightward and leftward swing motion, as represented by the arrow mark A, through the movements of a crack shaft mechanism unshown. The folding arm 1 has at lower end a swing lever 3 and a pair of paper outfeed rolls 4 and 5 mounted thereto. The two rolls 4 and 5 (which will be termed left and right rolls according to the directions in the illustrations) are rotatably mounted to their respective axles 6 and 7 attached to the swing lever 3. Upon being fed outwardly between the two rolls 4 and 5 rotating in opposite directions, the paper strip is folded in a zigzag by the rightward and leftward swing movements of the arms 1.

The swing lever 3 swings rightwards and leftwards about the center-axle 6 (which will be termed a lever-center axle) of the left roll 4, as represented by the arrow B, through the reciprocating movements of a crank mechanism 8. By the swing movements of the swing lever 3, the right roll 5 is moved in swing motion about the center-axle 6 of the left roll 6 so as to assist the folding arm 1 in its paper folding operation (as will be temed an auxiliary folding operation hereinafter).

As shown in FIG. 12, a drive pulley 9 driven by a motor unshown is mounted to the arm-center shaft 2 while an idle pulley 10 is mounted to the lever-center axis 6, between which pulleys a belt 11 is fitted. These members form a roll rotating mechanism which drives both the rolls 4 and 5 for rotation. As shown in both the illustrations, the numeral 12 is a guide member for outfeeding the paper strip.

Disadvantages in the aforesaid known arrangement are, as follows.

(I) As the right roll 5 moves in the swing motions against the left roll 4 fixed in position during the auxiliary folding operation, the point of contact C between both the rolls 4, 5, as a paper outfeeding point, changes its position constantly, which results in an intensive force such as tension exerted on the paper strip. Particularly, while a swing angle is great as needed, a rate of the position change becomes increased thus to affect the paper strip greatly.

(II) Since the small-diameter left roll 4 is directly driven for rotation by the belt drive roll rotating mechanism, the proximal region of the left roll 4 is affected greatly. In case that the proximal area of the left roll 4 are reinforced in construction, the lower portion of the folding arms 1 becomes heavier, which increases the force of inertia on the folding arm 1 and therefore, will shorten the life of a folding arm mechanism, etc.

To solve the problem about the auxiliary folding operation described above in (I), the contact point C between the two rolls 4 and 5 can be equal in position to the swing center of the swing lever 3. However, although this permits the roll contact point C to rest in position, the distance between the pulleys in the roll rotating arrangement varies as the left roll 4 swings about the contact point C, which then requires an additional mechanical arrangement in which the length of the pulley belt can be changed automatically in accordance with the auxiliary folding operation. Consequently, this develops another problem that the arrangement becomes intricate in construction.

Additionally, the known zigzag folding apparatus D1 has a swing section including the paper outfeed guiding device pivotably mounted to the lower end of the folding arm which swings about the axis in the upper end thereof. The folding arms and paper outfeed guiding device are activated by their respective crank mechanisms for the swing movements in the arrangement so that the paper strip passed through the paper outfeed guiding device can be folded in a zigzag along the transversely perforated lines arranged therein.

According to the arrangement, in order to alter the swing angle (which will be termed a width of swing stroke) in the swing section in accordance with the locations (folding positions) of the transversely perforated lines, an eccentric crank is displaced in relation to a rotary disk in the crank arrangement thus to change the eccentiricity or the length of the swing stroke. This adjustment can be done while the machine remains rested, which interrupts the folding operation and therefore, will result in a decrease in working efficiency.

It is apparent that the present invention intends to solve the aforesaid problems.

It is an object of the present invention to provide a zigzag folding apparatus for a form printing machine wherein the distance between the drive and idle pulleys in the roll rotating arrangement can remain constant while the point of contact between a pair of the rolls coincides approximately with the swing center of the swing lever and furthermore, no unnecessary load is exerted on the proximal area of the primary roll.

It is another object of the present invention to provide a zigzag folding apparatus for a form printing machine wherein the adjustment on a width of the swing stroke at the swing section can be made without stopping the machine.

The further objects and advantages of the invention will be apparent from the following description.

SUMMARY OF THE INVENTION

The present invention is directed towards the improvement comprising: housings being pivotably mounted with their respective horizontal axes coinciding with each other to the lower ends of a pair of folding arms respectively so as to rotate about the axes thereof in relation to the folding arms which are pivotably mounted at upper end on their respective shafts for rightward and leftward swing motion; a pair of rolls for outfeeding a paper strip being horizontally rotatably mounted between both the housings so that the point of contact between the peripheries of the rolls can coincide approximately with the center axis of the housings; a swing lever being mounted to one of the houdings so as to swing rightwards and leftwards about the housing center axis together with the housing; an idle pulley being mounted to one of the folding arms disposed on the opposite housing with its rotating centerline coinciding with the housing center axis; an internal gear being mounted to the idle pulley; a gear being mounted to one of the rolls so as to mesh with the internal gear; and a drive pulley for driving the idle pulley being mounted on a swing shaft of the folding arm.

According to the arrangement, the swing centerline of the swing lever lies on the point of contact between the rolls so that the roll contact point can remain stationary during the auxiliary folding operation. Additionally, the axis of the idle pulley in the roll rotating arrangement coincides with the axis of the swing centerline so that the distance between the drive and idle pulleys can remain unchanged. The rotating power on the idle pulley is transmitted to the roll via a gearing drive mechanism including the internal gear of the idle pulley, which will prevent an excessive force from being exerted on the proximal area of the roll.

The present invention is also directed towards an improved zigzag folding apparatus for a form printing machine, including a swing section which have a paper outfeed guiding member and is driven by a swing drive mechanism thus to perform the swinging motion about a specific axis, by which motion a paper strip is folded in a zigzag. The swing drive mechanism comprises: a drive shaft being driven for rotation by a motor; a cam mechanism for converting the rotation of the drive shaft into a quick forward and reverse turning motion at a specific angle; swing main shafts being connected with the cam mechanism for the forward and reverse turning motion at a specific angle; and swing output shafts being arranged parallel to the swing main shafts and connected drivingly with the the swing section. Each of the swing main and swing output shafts has a swing arm extending at a right angle thereto. The swing arms have recessed guide ways formed therein across the axes of the swing main and swing output shafts respectively. Each guide way has a slider slidably engaged therewith. Both the sliders are joined by means of a slider joint shaft arranged parallel to both the swing main and swing output shafts so as to turn against each other about the axes of the swing main shaft and the swing output shaft respectively. Accordingly, the swing drive mechanism can transmit the forward and reverse motion of the swing main shaft to the swing output shaft. Additionally, a screw shaft is screwed into one of the sliders in axially fixed relationship so that the slider can be displaced within the guide way by rotating the screw shaft thus to change the crosswise distances from the slider joint shaft to the swing main shaft and the swing output shaft respectively.

The slider is displaced by the rotation of the screw shaft, whereby a ratio of transmitting the forward and reverse motion from the swing main shaft to the swing output shaft is changed to alter a width of swinging on the swing section. Consequently, the adjustment of the swinging width can be made without stopping the machine.

DETAILED DESCRIPTION OF PREFERRED EMBODIMENT

Figure 1:
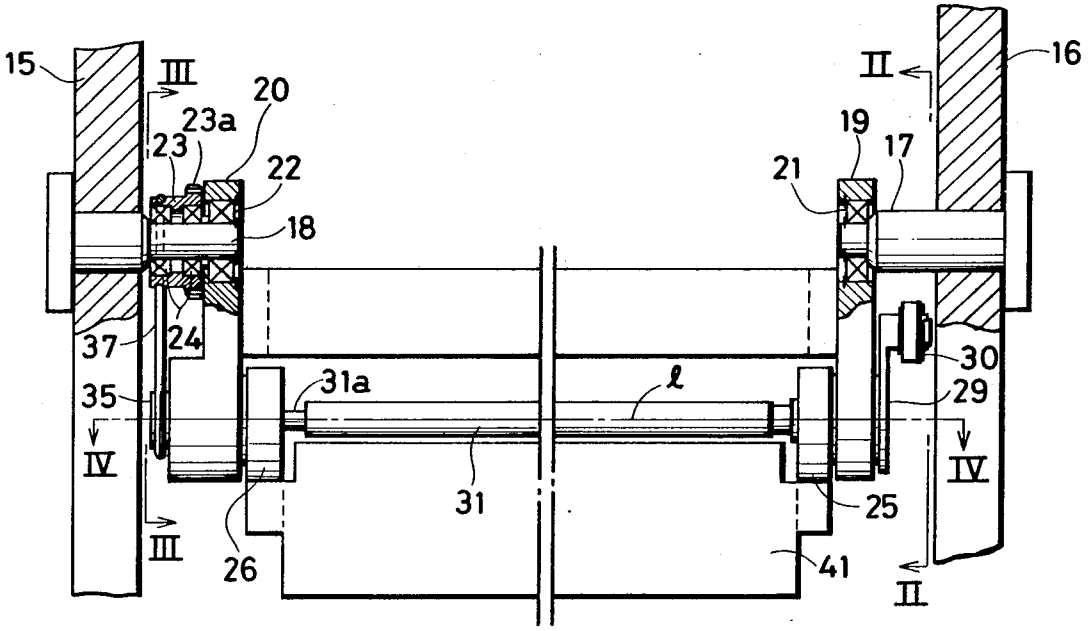
FIG. 1 is a partially cross-sectional view of a first preferred embodiment according to the present invention.

A first preferred embodiment of the present invention is shown in FIGS. 1 through 4. As shown in the illustrations, the numeral 15 and 16 are a pair of front and rear arm support members having respectively horizontal shafts 17 extending in the frontward and rearward directions. A pair of front and rear folding arms 19, 20 are pivotably mounted by means of bearings 21 and 22 to their respective horizontal shafts 17 and 18 so as to be swung rightwards and leftwards about the horizontal shafts 17, 18 (as will be termed arm-axis shafts hereinafter), as represented by the arrow Y in FIG. 2, by the reciprocating movements of a crank mechanism unshown. A drive pulley (drive wheel) 23 in a belt drive mechanism or a roll rotating arrangement is rotatably mounted by means of a bearing 24 to the arm-axis shaft 18 in the rear side (at left in FIGS. 1 and 4, as the right corresponds to the front in a direction). A plane gear wheel 23*a* is integrally mounted to the drive pulley 23 to which the drive motion from a motor (not shown) is transmitted through the plane gear wheel 23*a*.

Tubular housings 25 and 26, horizontally extending axes of which coincide with each other, are mounted by means of bearings 27 and 28 respectively to the lower ends of their respective folding arms 19, 20 so as to rotate about a through axis l. A swing lever 29 is intergrally mounted to the front side of the front housing 25 so as to swing rightwards and leftwards about the housing axis l. The numeral 30 is a crank mechanism for swinging the lever 29.

A pair of right and left rolls 31, 32 have, at both ends, rotating shaft portions 31*a* and 32*a* journalled on bearings 33 and 34 within the housings 25 and 26 so that the peripheries of both the rolls are engaged in contact relationship while the point of contact C between the same lies coaxially on the housing axis l. More specifically, the two rolls 31, 32 can swing rightwards and leftwards about the housing axis 1 (point of roll contact C) together with the housings 25, 26 during the rightward and leftward swinging motion of the swing lever 29, while rotating about their respective axes. Both the rolls 31 and 32 perform the auxiliary folding operation by swinging rightwards and leftwards about the contact point C thus to eliminate a move of the roll contact point C, which will prevent an unnecessary load from being exerted on the paper strip.

Figure 2:
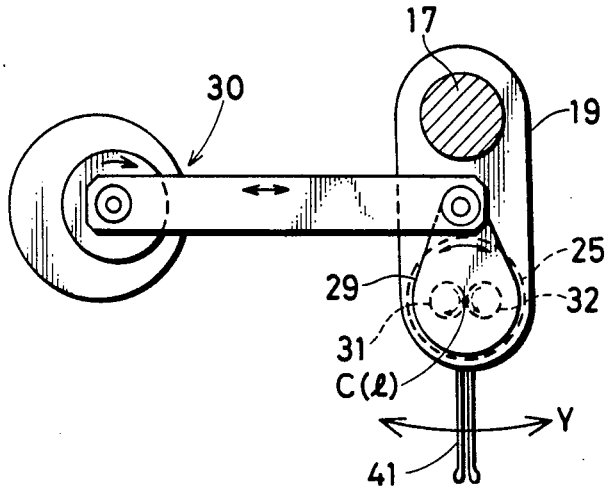
FIG. 2 is a cross-sectional view taken along the line II—II of FIG. 1.
Figure 3:
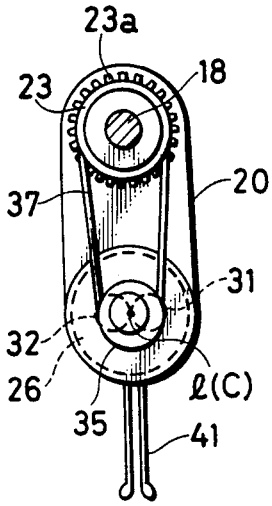
FIG. 3 is a cross-sectional view taken along the line III—III of FIG. 1.
Figure 4:
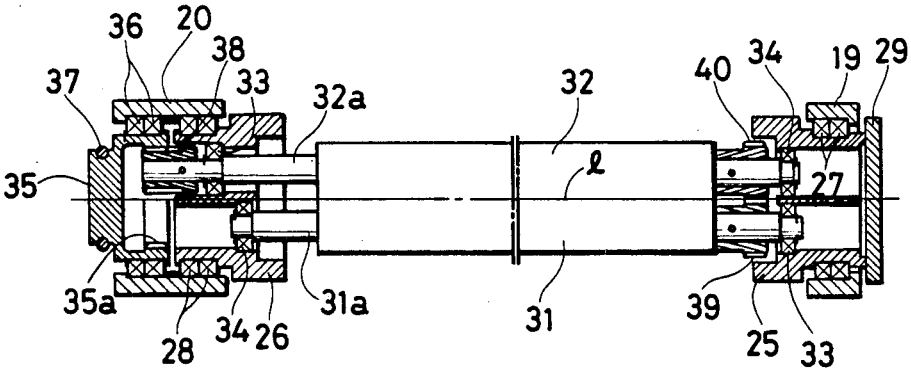
FIG. 4 is an enlarged cross-sectional view taken along the line IV—IV of FIG. 1.

At the opposite end, a idle pulley 35 is rotatably mounted by means of a bearing 36 to the folding arm 20 including the rear housing 26 so that a rotating axis thereof coincides with the housing axis l. A belt 37 is fitted at tension between the drive and idle pulleys 23, 35 thus to form the belt drive mechanism (roll rotating arrangement). The idle pulley 35 has an internal gear portion 35*a* formed therein so as to be engaged with an intermediate plane gear wheel 38 mounted to the rear end of the rotating shaft 32*a* of the right roll 32. Drive plane gears 39 and 40 are mounted to their respective rotating shafts 31*a*, 32*a* of the rolls 31, 32 so as to mesh with each other. In the arrangement, the rotation from the belt drive mechanism will be transmitted from the idle pulley 35 through the internal gear 35*a*, the intermediate plane gear 38, and the drive plane gears 40, 39 in this order to the rolls 31, 32 which thus rotate in opposite directions to outfeed the paper strip. More specifically, the rolls 31, 32 performs the operation of outfeeding the paper strip while assisting the paper folding operation by swinging rightwards and leftwards about the housing axis l (roll contact point C) together with the housings 25, 26 through the rightward and leftward swinging motion of the swing lever 29. As shown in FIGS. 1 through 3, the numeral 41 is a guide member for outfeeding the paper strip. In the zigzag folding apparatus, (1) The rolls 31 and 32 swing about their mutual contact point C so that the contact point C remains stationary during the auxiliary folding operation, which thus prevents an excessive force such as pulling tension from being exerted on the paper strip passing between the rolls 31, 32.

(2) Additionally, the distance between the pulleys in the belt drive mechanism remains unchanged during the auxiliary folding operation as the rotating axis of the idle pulley 35 coincides with the axis of roll swinging motion C (as the housing axis l). Therefore, no extra arrangement such as a belt length adjusting device is required in the mechanism.

(3) The drive power for rotating the rolls is transmitted from the idle pulley 35 via the intermediate plane gear 38 engaged with the internal gear 35*a* of the pulley 35 to the roll 32, which prevents the proximal region of the roll 32 from bearing an intensive load which may be exerted when the roll 32 is driven in a direct manner. There is no need to reinforce the roll proximal region neither an increase in overloading about the arms which may be effected by the increased weight of the lower portion of the the folding arms.

Although the aforesaid embodiment employs a belt drive mechanism as a roll rotating arrangement, a chain drive mechanism can be also used. In this case, the drive and idle pulleys 23, 35 in the embodiment may be replaced with sprockets between which a chain is fitted.

It is ideal to have the point of roll contact C coinciding coaxially with the housing axis l (swing lever axis) as arranged in the aforesaid embodiment in order to protect the papar strip form bearing an unnecessary load during the auxiliry folding operation. Nevertheless, the slight deviation from the coaxial arrangement may be permitted to provide a practically equal success in operation, yet comparatively more dependable than that of the prior art.

According to the present invention, while the point of contact between the two rolls coincides approximately with the swing axis of the swing lever, the distance between the drive and idle pulleys in the roll rotating arrangement remains constant. This protects the paper strip from bearing an excessive load during the auxiliary folding operation with the rolls swinging and moreover, will eliminate the need of an extra arrangement such as a belt length adjusting mechanism in the roll rotating arrangement, which results in the simplicity in construction. Furthermore, the roll proximal region is protected from bearing an unnecessary force for transmitting the rotating power, which exempts the roll proximal region from reinforcement thus to prevent an increase in overloading about the folding arms.

Figure 5:
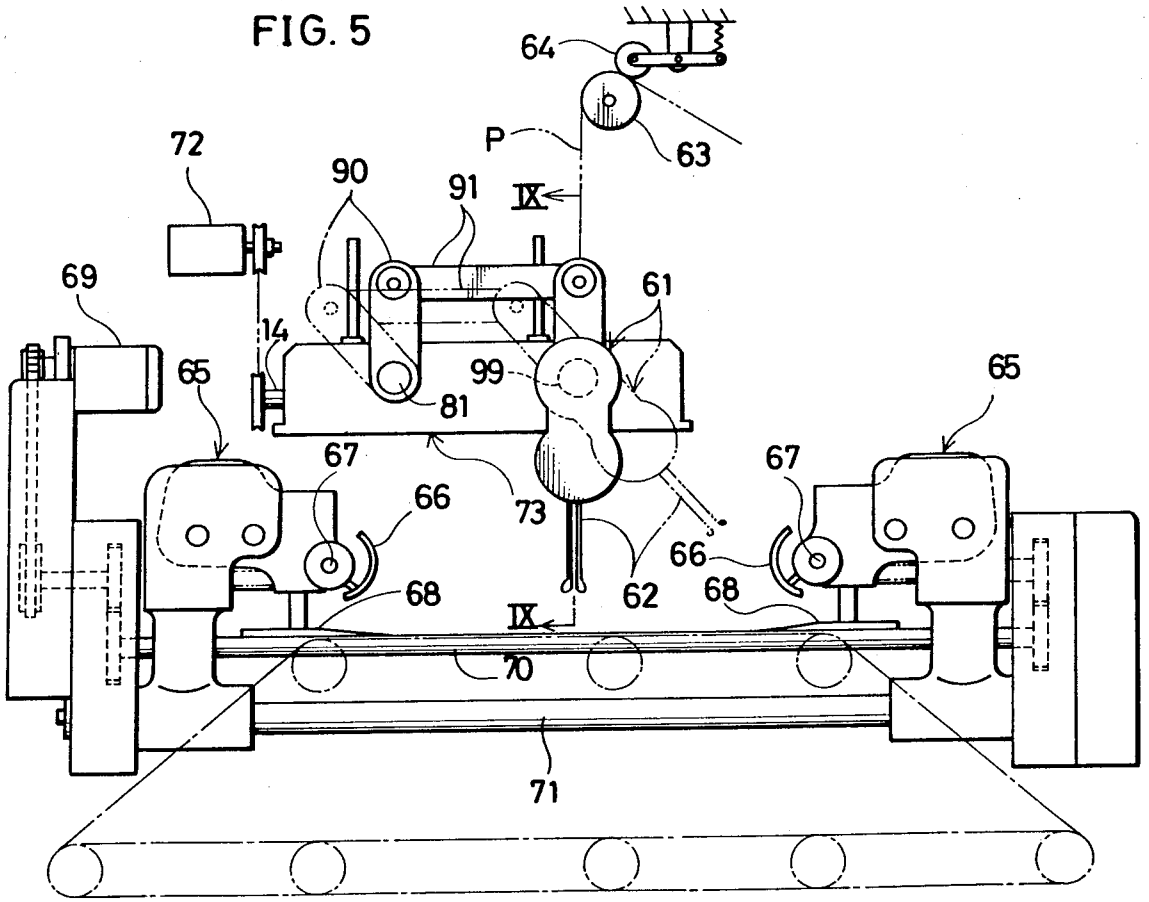
FIG. 5 is a front view illustrating the entire arrangement of a zigzag folding apparatus according to a second preferred embodiment of the invention.

A second preferred embodiment will be described in conjunction with the drawings. The entire arrangement of a zigzag folding apparatus of the embodiment is shown in FIG. 5. As shown in the illustration, the numeral 61 is a folding arm included in a swing section while the numeral 62 is a guide member for outfeeding the paper strip. The paper strip P, which intends to pass between an outfeed roller 63 and a nip roller 64 through the paper outfeed guide 62, is folded in a zigzag by the swinging movements of the folding arm 61 and the guide 62 upon being outfed in a downward direction, in the illustration, through the paper outfeed guide 62.

The numerals 65, 65 are a pair of auxiliary folding devices disposed symmetrically about the paper outfeed guide 62 on the right and left sides. Arc-shaped patter members 66, 66 are disposed in their respective auxiliary folding device 65, 65 so as to turn about shafts 67, 67. The paper strip P will be folded along the perforated lines therein upon being pressed downwardly by the turning motions of the patters 67, 67 synchronized with the swinging motion of the paper outfeed guide 62. The numerals 68, 68 are spirals for holding the paper strip P at its perforated lines; 69 is a drive motor for positioning the auxiliary folding devices 65, 65; 70 is a connecting shaft for synchronizing at both ends the auxiliary folding devices 65, 65; and 71 is a support shaft for supporting the auxiliary devices.

Figure 6:
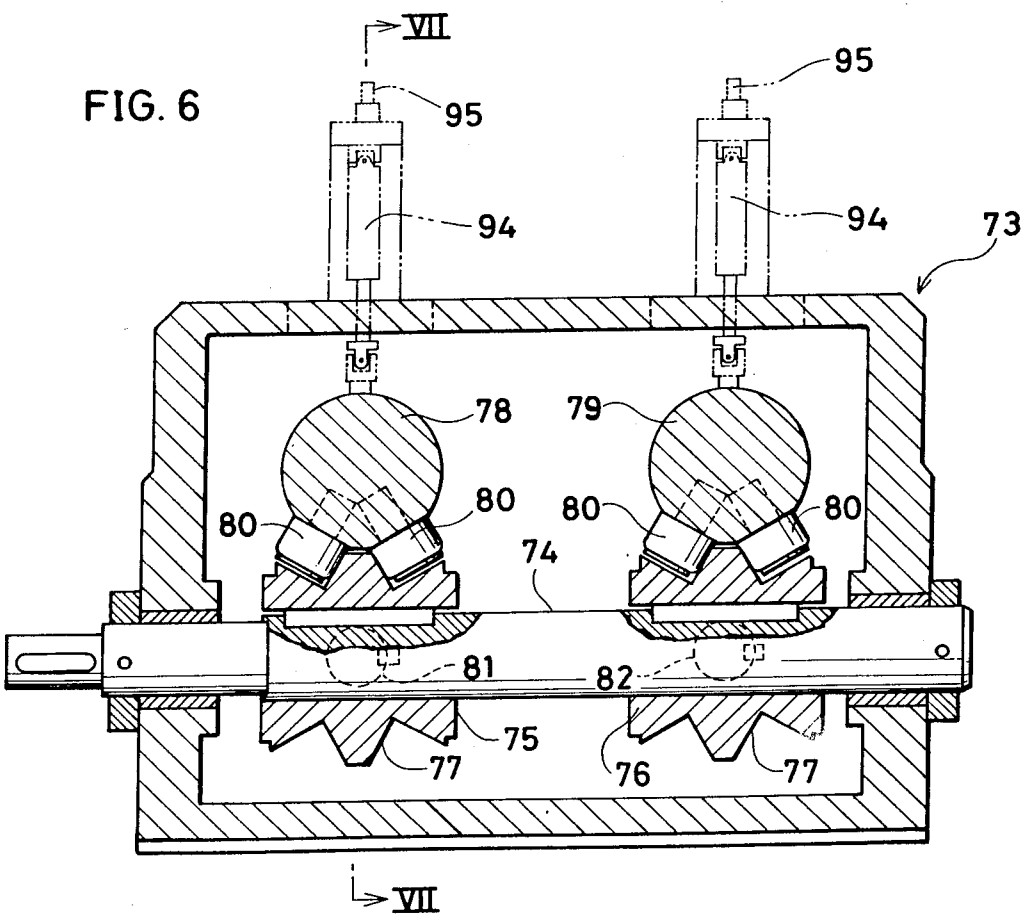
FIG. 6 is a cross-sectional view of a swing drive mechanism of the apparatus.

The folding arm 61 and the paper outfeed guide 62 are activated for swinging motion by a swing drive mechanism 73 driven by a motor 72. The arrangement of the swing drive mechanism 73 will be described in conjunction with FIGS. 6 and 8.

The numeral 74 is a drive shaft driven for rotation by the motor 72. Both first and second cams 75, 76 for the folding arm and the paper outfeed guide respectively are co-rotatably mounted to the drive shaft 74. Each of the cams 75 and 76 has a cross-sectionally convexshaped projection 77 formed over the periphery thereof. Accordingly, each projection 77 is engaged with a pair of right and left cam followers (rollers) 80, 80 mounted to a first swing main shaft 78 for the folding arm or to a second swing main shaft 77 for the paper outfeed guide. The projection 77 is formed into a circumferentially spiral configuration so that the first swing main shaft 78 or the second swing main shaft 79 can be rotated in quick forward and reverse (rightward and leftward) motion about its axis while turning at a specific angle (e.g. of 60°) by the cam motion of the projection 77 and cam followers 80, 80 during the rotation of the drive shaft 74.

The forward and reverse motions of the swing main shafts 78, 79 are transmitted via their respective transmission mechanisms A1 and A2 to first and second swing output shafts 81, 82 for the folding arm and the paper outfeed guide respectively. The transmission mechanism A1 and A2 are indentical in construction, as shown typically in FIGS. 7 and 8. The swing main shaft 78 or 79 and the swing output shaft 81 or 82 are arranged so that their respective axes a and b are in parallel with each other. The main and output shafts have, at the confronting ends thereof, swing arms 83 and 84 respectively which are projected at right angles to their axes. The swing arms 83 and 84 have respectively recessed guide ways 85 and 86 extending across the axes of their respective shafts. A first slider 87 is slidably engaged with the swing main shaft guide way 85 (as will be termed a first guide way hereinafter) while a second slider 88 is slidably engaged with the swing output shaft guide way 86 (as will be termed a second guide way). The first slider 87 is formed into a square tubular configuration having a female thread therewithin while the second slider 88 is formed into a rectangular solid. Both the sliders 87 and 88 are joined each other by means of a slider joint shaft 89 arranged parallel to the main and output shafts 78, 81 or 79, 82 so as to turn relatively against each other. Accordingly, the forward and reverse rotation of the swing main shaft 78 or 79 is transmitted via the first guide way 85, the first and second sliders 87, 88 and the second guide way 86 to the swing output shaft 81 or 82.

A transmitting ratio of the forward and reverse rotation transmitted from the swing main shaft 78 or 79 to the swing output shaft 81 or 82 varies in accordance with the relative positions of the sliders 87 and 88. Particularly, when the distance x between the slider center c (axial center of the slider joint shaft 89) and the axial center a of the swing main shaft is equal to the distance y between the slider center c and the axial center b of the swing output shaft, the stroke lengths of turning on the swing main shaft 78 or 79 and the swing output shaft 81 or 82 become equal as the transmitting ratio is 1. The transmitting ratio becomes smaller as the distance x becomes shorter (than the distance y). Accordingly, when X=0 or the slider center c coincides coaxially with the axial center a of the swing main shaft, the transmitting ratio will be 0 and thus, the forward and reverse rotation of the swing output shaft 81 or 82 will stop. The forward and reverse rotation of the first swing output shaft 81 is transmitted via a connecting arm 90 and a connecting link 91 shown in FIGS. 5 and 10 to the folding arm 61, while the same of the second swing output shaft 82 is transmitted via a transmission arrangment, as will be described later herein, to the paper outfeed guide 62. Thus, the stroke lengths of turning on the swing output shafts 81, 82 or the stroke lengths of swinging on the folding arm 61 and the paper outfeed guide 62 can be adjusted respectively by displacing the sliders 87 and 88 along their respective guide ways 85, 86.

Figure 7:
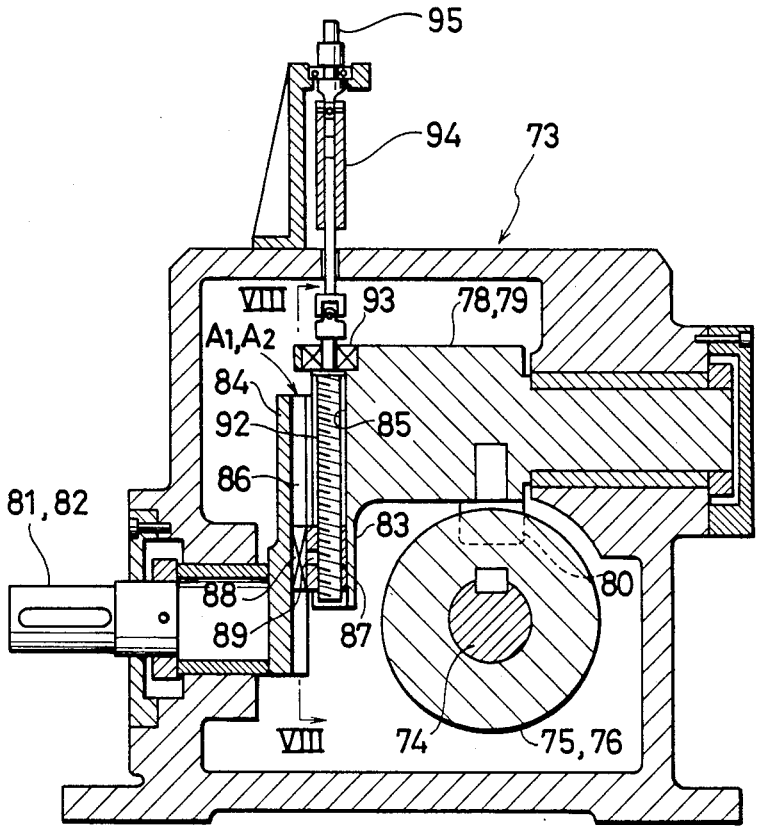
FIG. 7 is a cross-sectional view taken along the line VII—VII of FIG. 6.
Figure 8:
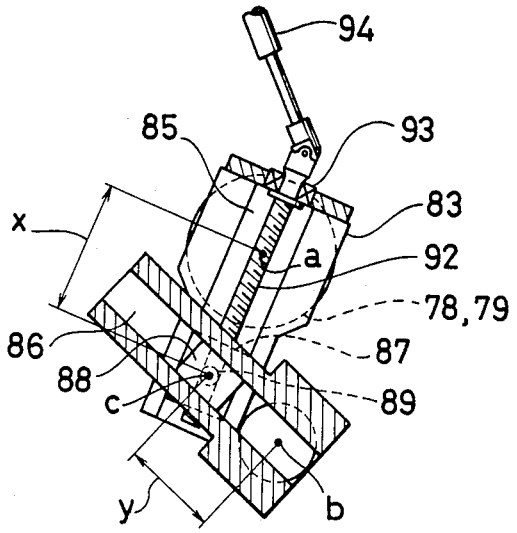
FIG. 8 is a cross-sectional view taken along the line VIII—VIII of FIG. 7.

In the slider displacement operation arrangment, as best shown in FIGS. 7 and 8, a screw shaft 92 is screwed into the the first slider 87 in the first guide way 85. The screw shaft 92 is mounted for non-movement either axially or in rotating directions of the swing main shaft by means of a bearing 93 to the swing main shaft 78 or 79, and connected at top end with an operating shaft 95 by means of a universal joint 94. The operating shaft 95 is driven for forward and reverse rotation by a pulse motor, not shown. As the operating shaft 95 rotates with the screw shaft 92 turning in a thread against the first slider, the slider 87 or 88 moves within the guide way 85 or 86 upon turning in a crosswise plane together with the swing main shaft 78 or 79, whereby the stroke length of swinging on the folding arm 61 or the paper outfeed guide 62 is changed.

Accordingly, while the swing drive mechanism 73 or a zigzag folding apparatus continues to operate, the adjustment of a stroke length of swinging can be made in accordance with a change of the positions of the transverse perforated lines in the paper strip.

The arrangement for transmitting the forward and reverse rotation of the second swing output shaft 82 to the paper outfeed guide 62 will be described in conjunction with FIGS. 9 and 10. The numeral 96 is an arm center shaft about which the folding arm 61 swings. The arm center shaft 96 is co-rotatably connected by means of a shaft joint 97 to the second swing output shaft 82. The numeral 98 is a frame for supporting the arm center shaft 96 and 99 is a bearing for supporting the same.

The folding arm 61 is pivotably mounted to the arm center shaft 96 by means of a bearing 100. A gear shaft 101 parallel to the arm center shaft 96 is rotatably mounted by means of a bearing 102 to the lower end of the folding arm 61 so that an idle gear 103 mounted to the gear shaft 101 can be engaged with a drive gear 104 mounted to the arm center shaft 96. A gear box 105 is secured to the gear shaft 101 while the paper outfeed guide 62 is mounted to the gear box 105. Accordingly, the forward and reverse motion of the second swing output shaft 82 is transmitted via the arm center shaft 96, the drive gear 104, the idle gear 103, the gear shaft 101, and the gear box 105 to the paper outfeed guide 62.

Figure 9:
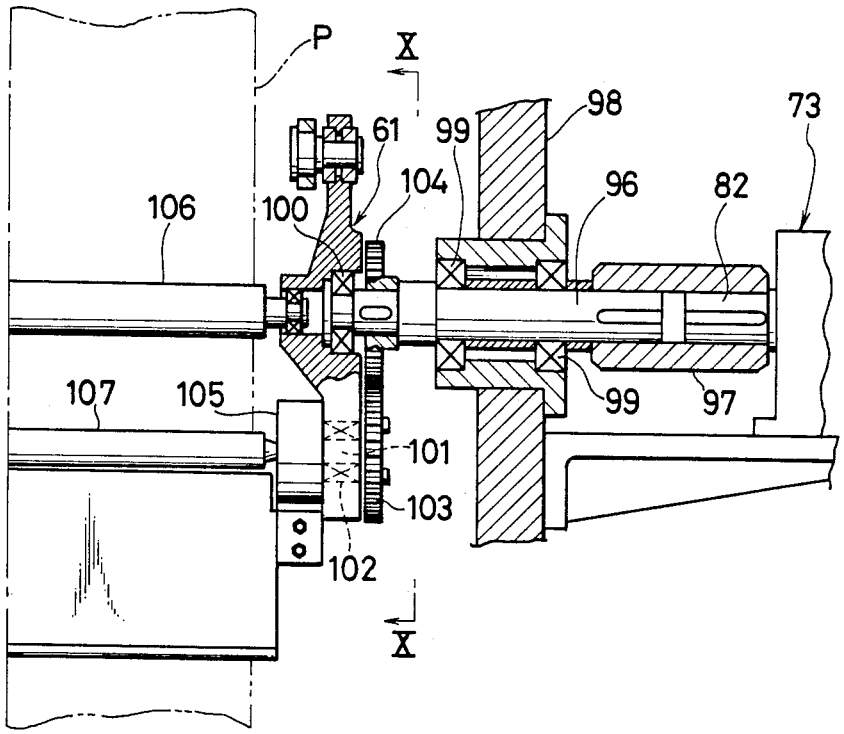
FIG. 9 is a cross-sectional view taken along the line IX—IX of FIG. 5.
Figure 10:
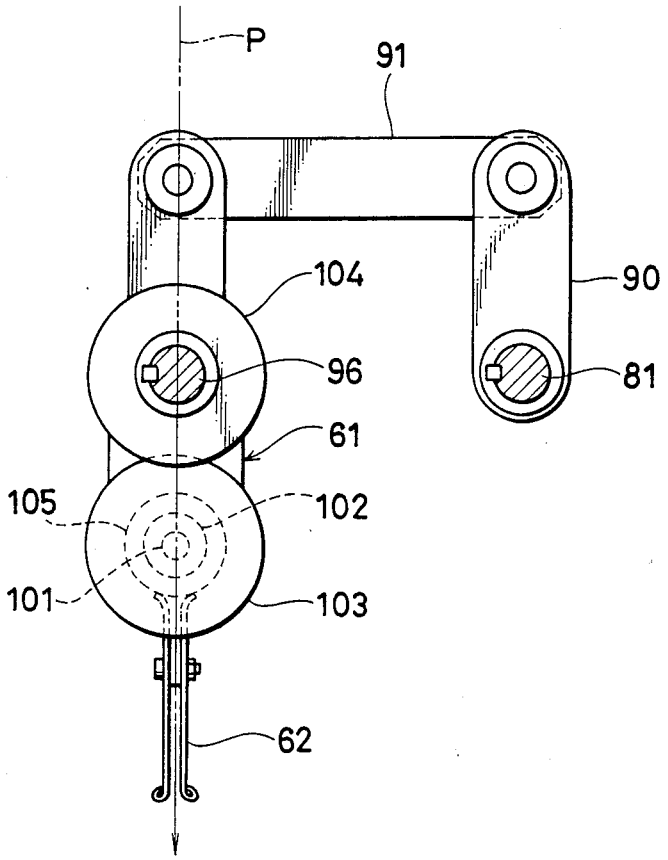
FIG. 10 is a half cross-sectional view taken along the line X—X of FIG. 9.
Figure 11:
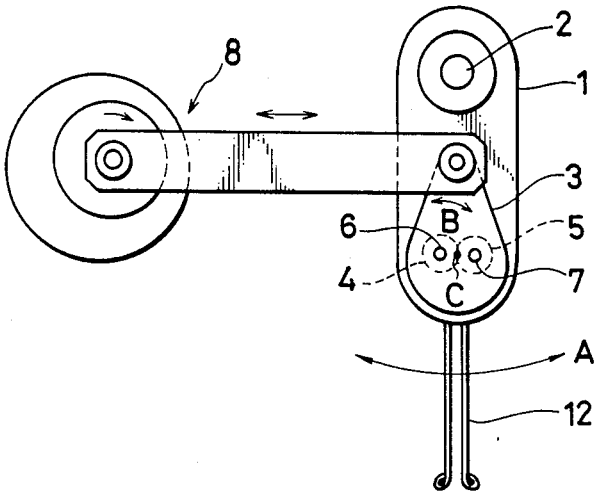
FIG. 11 PRIOR ART
FIG. 11 is a view similar to FIG. 2 illustrating a prior art apparatus.
Figure 12:
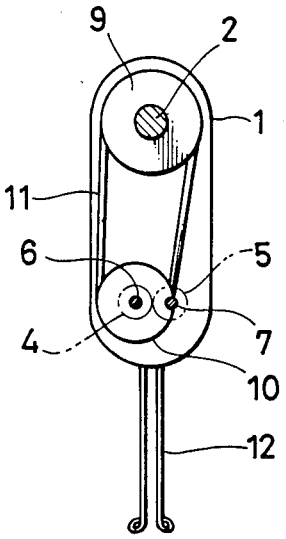
FIG. 12 PRIOR ART
FIG. 12 is a cross-sectional view of the prior art apparatus.
Figure 13:
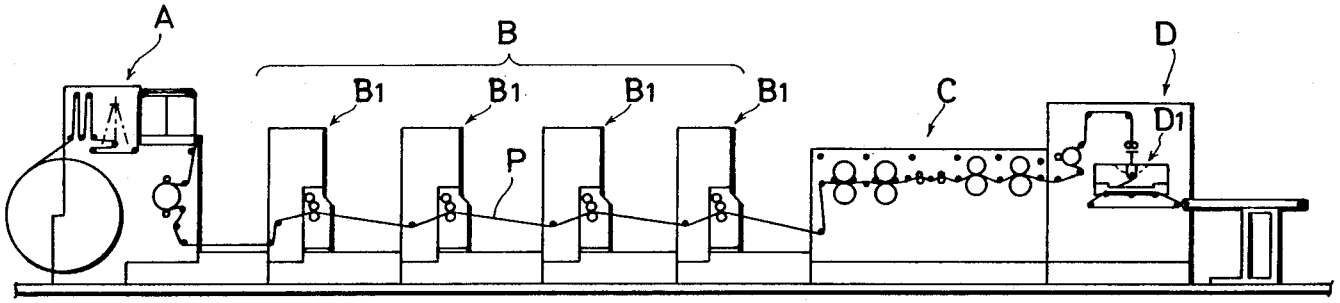
FIG. 13 is a view illustrating the entire arrangement of a form printing machine.

As shown in FIG. 9, the numeral 106 is a paper guide roller while 107 is a paper outfeed roller. The paper outfeed roller 107 is driven for rotation by a motor unshown via both gearing and belt drive mechanisms, not shown, in the gear box 105.

The following arrangements may be utilized other than that of the embodiment.

(1) Although the operating shaft 95 connedted by means of the universal joint 94 with the screw shaft 92 is driven for rotation by the pulse motor according to the embodiment, a handle may be mounted to the operating shaft 95 so that the operating shaft 95 can be turned manually with the handle.

(2) Although the screw shaft 92 moving together with the swing main shaft 78 or 79 is connected by means of the universal joint 94 with the operating shaft 95 fitted stationarily for operating in rotating motion according the embodiment, a motor such as a hydraulic motor may be disposed on the swing main shaft 78 or 79 thus to rotate directly the screw shaft 92 for adjustment. In this case, electrical wirings or hydraulic pipings to the motor can be flexibly attached so as to remain connected in the forward and reverse motion of the motor.

(3) Although the screw shaft 92 is screwed into the first slider 87 according to the embodiment, it may be screwed into the second slider 88.

According to the present invention, as set forth above, in the swing drive mechanism for driving the swing section for folding the paper strip in a zigzag through the swinging motion, the improvement includes a swing transmission mechanism disposed between a wing main shaft co-rotatably connected with a cam mechanism and a swing output shaft arranged parallel to the swing main shaft and co-rotatably connected with the swing section, the swing transmission mechanism comprising sliders movable at right angles to said shafts and guide ways for the sliders, the slider having a screw shaft screwed thereinto so as to be moved by rotatinng the screw shaft, so that a ratio of transmitting from the swing main shaft to the swing output shaft can vary. This arrangement will thus permit the swing section to be adjusted to a width of swinging according to the folding locations of the paper strip during the operation of the machine. Accordingly, there is no need to interrupt the folding operation when the swing width adjustment is made, which will provide high efficiency in production.

What is claimed is:

1. A zigzag folding apparatus for a form printing machine, comprising: housings being pivotably mounted with their respective horizontal axes coinciding coaxially with each other to the lower ends of a pair of folding arms respectively so as to rotate about the axes thereof in relation to said folding arms which are pivotably mounted at upper end on their respective shafts for rightwardly and leftwardly swinging motion; a pair of rolls for outfeeding a paper strip being horizontally rotatably mounted between said housings so that the point of contact between the peripheries of the rolls can coincide approximately with a through axis of the housings; a swing lever being mounted to one of said housings so as to swing rightwards and leftwards about the housing center axis together with the housing; an idle pulley being mounted to one of said folding arms disposed on the opposite housing with its rotating centerline coinciding with the housing center axis; an internal gear being mounted to said idle pulley; a gear being mounted to one of said rolls so as to be engaged with said internal gear; and a drive pulley for driving said idle pulley being mounted on a swing shaft of the folding arm.

2. A zigzag folding apparatus for a form printing machine, including a swing section which has a paper outfeed guiding member and is driven by a swing drive mechanism thus to perform the swinging motion about a specific axis, by which motion a paper strip is folded in a zigzag, said swing drive mechanism comprising: a drive shaft being driven for rotation by a motor; a cam mechanism for converting the rotation of said drive shaft into a quick forward and reverse turning motion at a specific angle; swing main shafts being connected with said cam mechanism for the forwrad and reverse turning motion at a specific angle; and swing output shafts being arranged parallel to said swing main shafts and connected drivingly with the the swing section, each of said swing main and swing output shafts having a swing arm extending at a right angle thereto, said swing arms having recessed guide ways formed therein across the axes of said swing main and swing output shafts respectively, each of said guide ways having a slider slidably engaged therewith, both said sliders being joined by means of a slider joint shaft arranged parallel to both said swing main and swing output shafts so as to turn against each other about the axes of said swing main shaft and said swing output shaft respectively so that said swing drive mechanism can be formed thus to transmit the forward and reverse motion of said swing main shaft to said swing output shaft, additionally, a screw shaft being screwed into one of said sliders in axially fixed relationship so that said slider can be displaced within said guide way by rotating the screw shaft thus to change the crosswise distances from said slider joint shaft to said swing main shaft and said swing output shaft respectively.

* * * * *